US007178559B2

(12) United States Patent
Tielemans et al.

(10) Patent No.: US 7,178,559 B2
(45) Date of Patent: Feb. 20, 2007

(54) WEBBING BELT

(75) Inventors: Jac Tielemans, Boxtel (NL); Petrus Johannes Gerardus Maria Van Haaren, Liempde (NL)

(73) Assignee: Forrester Ketley & Co., London (GB)

( * ) Notice: Subject to any disclaimer, the term of this patent is extended or adjusted under 35 U.S.C. 154(b) by 440 days.

(21) Appl. No.: 10/660,376

(22) Filed: Sep. 11, 2003

(65) Prior Publication Data

US 2005/0056335 A1 Mar. 17, 2005

(51) Int. Cl.
*D03D 13/00* (2006.01)

(52) U.S. Cl. ..... 139/117; 139/383 R; 139/431; 139/384 R

(58) Field of Classification Search ..... 139/117, 139/426 R, 383 R, 384 R, 431, 432
See application file for complete search history.

(56) References Cited

U.S. PATENT DOCUMENTS

| | | | | | |
|---|---|---|---|---|---|
| 37,546 | A * | 1/1863 | Gouilloud | ..... | 139/117 |
| 1,037,752 | A * | 9/1912 | Gaynor | ..... | 139/407 |
| 3,177,873 | A * | 4/1965 | Jamison | ..... | 604/384 |
| 4,018,960 | A * | 4/1977 | Berger et al. | ..... | 428/193 |
| 4,344,463 | A * | 8/1982 | Muller et al. | ..... | 139/383 R |
| 4,481,981 | A * | 11/1984 | Motte | ..... | 139/426 R |
| 4,660,605 | A * | 4/1987 | Koch | ..... | 139/420 R |
| 4,750,529 | A * | 6/1988 | Watanabe | ..... | 139/383 R |
| 4,981,161 | A * | 1/1991 | Pickering et al. | ..... | 139/383 R |
| 5,769,130 | A * | 6/1998 | Brielmann | ..... | 139/22 |
| 6,112,775 | A * | 9/2000 | Hossli et al. | ..... | 139/383 R |
| 6,164,692 | A * | 12/2000 | Takeuchi | ..... | 280/733 |
| 6,199,597 | B1 * | 3/2001 | David | ..... | 139/383 R |
| 6,705,244 | B1 * | 3/2004 | Berger et al. | ..... | 112/475.06 |
| 6,918,411 | B2 * | 7/2005 | Berger et al. | ..... | 139/434 |
| 2002/0189701 | A1 | 12/2002 | Berger et al. | | |

* cited by examiner

*Primary Examiner*—John J. Calvert
*Assistant Examiner*—Robert H Muromoto
(74) *Attorney, Agent, or Firm*—Madson & Austin

(57) ABSTRACT

Belts and methods of their manufacturing are provided. In one aspect, belts are manufactured by the steps of weaving the belt from a plurality of warp yarns and at least one weft yarn, the belt having a central region and two opposed edges. The warp yarns in the central region have a predetermined shrinkage characteristic. The belts also have at least one edge region between the central region and an edge of the belt has a predetermined number of warp yarns, each having a lesser shrinkage characteristic than the warp yarns of the central region. The method further includes the steps of passing the weft yarn across the warp yarns to effect a weaving in the central region of the belt. Further in the edge region, looping the weft yarn, on each pass, around a selected warp yarn, so that on a plurality of successive passes the weft yarn is looped around each of the warp yarns in the edge region. Subsequently, the yarns in the belt are shrunk.

24 Claims, 2 Drawing Sheets

WEBBING BELT

BACKGROUND OF THE INVENTION

1. Field of the Invention

THE PRESENT INVENTION relates to a webbing belt, and more particularly, but not exclusively, relates to a webbing belt suitable for use as a safety-belt in a motor vehicle.

2. Description of Related Art

Webbing belts are used as safety-belts in motor vehicles and also in aircraft, but webbing belts also find other applications, for example, as safety-belts incorporated in harnesses for climbers, window cleaners, etc.

Webbing belts, especially webbing belts used as seat-belts, are woven from warp and weft yarns, with the warp and weft yarns typically being multifilament yarns. Belts formed using such a technique will be very pliable.

It is desirable to make a webbing belt which is relatively stiff in the transverse direction, especially when the belt is to be used as a safety-belt in a motor vehicle, to spread the load which is applied to the vehicle occupant by the belt when an accident occurs. Transverse stiffness can be obtained in a belt by using weft yarns which are not of a multifilament construction, but which, instead, are monofilament weft yarns. Other significant advantages of using monofilament weft yarns is that they improve the reality properties of a safety-belt, meaning that the safety-belt does not twist as easily when being wound onto, or paid-out from, a retractor reel. Also, reduced twist means that the resulting safety-belt will be more comfortable for a vehicle occupant to wear.

A problem that arises when using monofilament weft yarns in the manufacture of a belt is that the edges of the belt will be very hard. This is clearly undesirable, especially in the context of a belt which is to be used as a seat-belt in a motor vehicle, especially where the belt may rub against the neck of a seat occupant.

It has been proposed before to provide a relatively soft edge for a belt which has monofilament weft yarns, by using an extra weft yarn and a knitting process at the edge portion. A belt of this type is disclosed is WO 01/48285. Because the described technique requires the use of an extra weft yarn and an additional operation, the technique is relatively costly and time-consuming.

It has also been proposed to use two weft yarns in parallel, namely a monofilament yarn and a multifilament yarn. The monofilament yarns are woven in such a way that each pass of the monofilament yarn ends at a point spaced from the edge of the belt, so that the monofilament yarns are always spaced a predetermined distance from the edge of the belt. Thus, in the edge region of the belt, there are only the relatively soft multifilament yarns. This arrangement is relatively complicated and requires provision of additional weft yarns.

It has also been proposed to weave a soft profile at the edge of the belt, as shown in DE 2,446,837, and it has even been proposed to weave a loop of fabric at the edge of the belt to obtain a hollow section, as shown in DE 2,508,732. All of these arrangements require special weaving apparatus or provide an edge portion of a substantially greater thickness than the central region of a belt. This is clearly undesirable, especially where the belt is to be wound on to a retractor spool.

SUMMARY OF THE INVENTION

The present invention, therefore, seeks to provide a method of manufacturing a belt with soft edges using weft yarns of monofilament, where the edges of the belt are relatively soft.

According to a first aspect of the present invention, there is provided a method of manufacturing a belt, comprising the steps of weaving the belt from a plurality of warp yarns and at least one weft yarn, the belt having a central region and two opposed edges, the warp yarns in the central region having a predetermined shrinkage characteristic, at least one edge region between the central region and an edge of the belt having a predetermined number of warp yarns, each having a lesser shrinkage characteristic than the warp yarns of the central region, the method comprising the steps of passing the weft yarn across the warp yarns to effect a weaving in the central region of the belt, and, in the or each edge region, looping the weft yarn, on each pass, around a selected warp yarn, so that on a plurality of successive passes the weft yarn is looped around each of the warp yarns in the edge region, the method comprising the subsequent step of shrinking the yarns in the belt.

Preferably the shrinking of the yarns is effected by passing the belt through an oven at a temperature of 180°–230° C.

Advantageously the yarns in the edge region are shrinkable yarns which are partially pre-shrunk.

Conveniently, on each successive pass the weft yarn is looped around a different warp yarn, which is not the same as the warp yarn selected for the preceding pass or for the following pass.

Preferably, in a series of successive passes the warp yarn is looped around each of the weft yarns in the edge region in a predetermined pattern, with that pattern subsequently being repeated.

Advantageously the warp yarns used in the edge region are thinner and light than the warp yarns used in the central region.

Conveniently the warp yarns used in the edge region are substantially 500 Denier (560 dtx) yarns, whereas the warp yarns used in the central region are substantially 1500 Denier (1670 dtx) yarns.

Preferably the weft yarn is of a diameter of 0.3 mm or less.

Advantageously on each successive pass the weft yarn is looped around a warp yarn which is next or next-but-one to the warp yarn selected for the preceding pass.

According to another aspect of the present invention, there is provided a method of manufacturing a webbing belt from warp yarns and a monofilament weft yarn, the method comprising the step of weaving the weft yarn with the warp yarns to produce a belt having a central region which is conventionally woven, and having at least one edge region in which the weft yarn, on successive is looped, passes around different selected warp yarns in the edge region.

Preferably the weft yarns in the edge region have a lesser shrinkage characteristic than the warp yarns of the central region, the method including a closing stop of shrinking the yarns in the belt.

Advantageously the shrinking of the yarns is effected by passing the belt through an oven at a temperature of 180° C.–230° C.

Conveniently the yarns in the edge region are shrinkable yarns which are partially pre-shrunk.

Preferably, in a series of successive passes the warp yarn is looped around each of the weft yarns in the edge region in a predetermined "pattern", with that "pattern" subsequently being repeated.

Advantageously the warp yarns used in the edge region are thinner and lighter than the warp yarns used in the central region.

Conveniently the warp yarns used in the edge region are substantially 500 Denier (560 dtx) yarns, whereas the warp yarns used in the central region are substantially 1500 Denier (1670 dtx) yarns.

Preferably the weft yarns is of a diameter of approximately 0.3 mm or less.

Advantageously, on each successive pass the weft yarn is looped around a warp yarn which is next to the next-but-one warp yarn selected for the preceding pass.

According to another aspect of the present invention, there is provided a method of manufacturing a belt having a central region and at least one edge region, the method comprising the steps of utilising warp yarns, the warp yarns used to form the edge region of the belt having a different shrinkage characteristic to the warp yarns used to form the central region of the belt, such that on shrinkage of the belt, the edge region yarns will shrink less than the central region yarns, the method comprising the further steps of weaving the belt using at least one monofilament weft yarn, and subsequently treating the belt to effect shrinkage of the yarns used in forming the belt.

Preferably during the weaving of the belt the weft is passed across the warp, to effect a conventional weaving in the central region of a belt and, in the or each edge region, the weft yarn is looped, in each pass, around a selected warp yarn, so that on each successive pass of the weft the weft yarn is looped around a different warp yarn, which is not the same as the warp yarn selected for the preceding pass or for the following pass.

Advantageously on a plurality of successive passes the weft yarn is looped around each of the warp yarns in the edge region.

Conveniently in a series of successive passes the warp yarn is looped around each of the weft yarns in the edge region in a predetermined "pattern", with that "pattern" subsequently being repeated.

Preferably the yarns in the edge region are shrinkable yarns which are partially pre-shrunk.

Advantageously the warp yarns used in the edge region are thinner and lighter than the warp yarns used in the central region.

Preferably the warp yarns used in the edge region are substantially 500 Denier (560 dtx) yarns, whereas the warp yarns used in the central region are substantially 1500 Denier (1670 dtx) yarns.

Advantageously the weft yarn is of a diameter of 0.3 mm or less.

Conveniently the belt is heat-treated to effect shrinkage of the yarns.

Preferably each successive pass of the weft yarn is looped around a warp yarn which is next or next-but-one to the warp yarn selected for the preceding pass.

According to another aspect of the present invention, there is provided a method of manufacturing a belt having a central region and at least one edge region comprising the steps of taking a plurality of warp yarns which are to form the belt, the warp yarns to form at least one edge region of the belt having a lesser weight and diameter than the warp yarns used to form a central region of the belt, and weaving the belt using at least one monofilament weft yarn.

Preferably in the edge region, on successive passes of the weft, the weft yarn is looped around a different warp yarn in the edge region, which is not the same as the warp yarn selected for the preceding pass or for the following pass.

Advantageously on each successive pass the weft yarn is looped around a warp yarn which is next or next-but-one to the warp yarn selected for the preceding pass.

Conveniently the warp yarns in the edge region have a lesser shrinkage characteristic than the warp yarns of the central region, the method comprising the subsequent step of shrinking the yarns in the belt.

Preferably the shrinking of the yarns is effected by passing the belt through an oven at a temperature of 180° C.–230° C.

Advantageously the yarns in the edge region are shrinkable yarns which are partially pre-shrunk.

Conveniently in a series of successive passes, the warp yarn is looped around each of the weft yarns in the edge region in a predetermined "pattern" with that "pattern" subsequently being repeated.

Preferably the warp yarns used in the edge region are substantially 500 Denier (560 dtx) yarns, whereas the warp yarns used in the central region are substantially 1500 Denier (1670 dtx) yarns.

Advantageously the weft yarn is of a diameter of 0.3 mm or less.

According to another aspect of the present invention, there is provided a belt formed from a plurality of warp yarns and at least one weft yarn, the belt having a central region and two opposed edges, there being at least one edge region between the central region and an edge of the belt in which successive passes of the weft yarn are each looped around a different selected weft yarn in the edge region.

Preferably each warp yarn in the edge region extends, as an arcuate length of yarn, between adjacent points where that warp yarn is looped by the weft yarn.

Advantageously in a series of successive passes the warp yarn is looped around each of the weft yarns in the edge region in a predetermined "pattern", with that "pattern" subsequently being repeated.

Conveniently the warp yarns in the edge region are thinner and lighter than the warp yarns used in the central region.

Preferably the warp yarns in the edge region are substantially 500 Denier (560 dtx) yarns, whereas the warp yarns used in the central region are substantially 1500 Denier (1670 dtx) yarns.

Advantageously the weft yarn is of a diameter of 0.3 mm or less.

According to a further aspect of the present invention, there is provided a belt formed from a plurality of warp yarns and at least one weft yarn, the belt having a central region and at least one edge region between the central region and an edge of the belt, the warp yarns in the edge region being thinner and lighter than the warp yarns used in the central region.

Preferably the successive passes of the weft yarn are each looped around a different selected warp yarn in the edge region of the belt.

Advantageously each warp yarn in the edge region extends, at an arcuate length of the yarn, between adjacent points where that warp yarn is looped by the weft yarn.

Conveniently in a series of successive passes the warp yarn is looped around each of the weft yarns in the edge region in a predetermined "pattern" with that "pattern" subsequently being repeated.

BRIEF DESCRIPTION OF THE DRAWINGS

In order that the invention may be more readily understood, and so that further features thereof may be appreciated, embodiments of the invention will now be described, by way of example, with reference to the accompanying drawings in which.

DETAILED DESCRIPTION OF THE INVENTION

Figure 1:
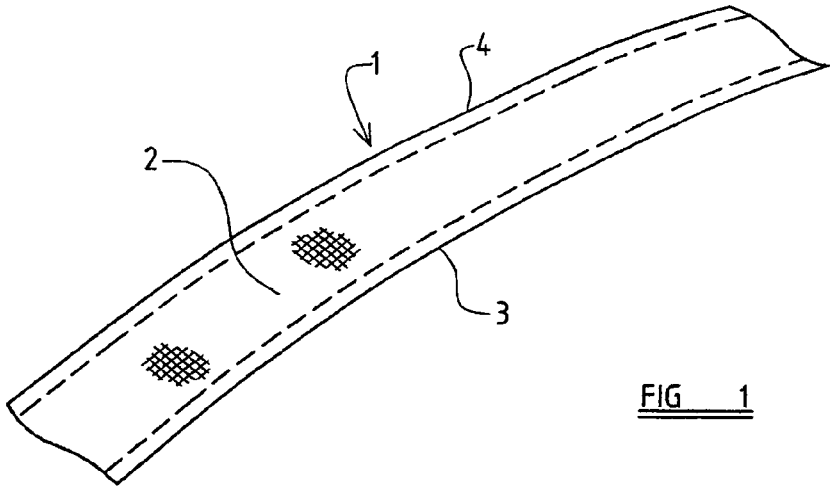
FIG. 1 is a perspective view of part of a belt.

Referring initially to FIG. 1, a belt 1 is illustrated. The belt 1 is of a size suitable for use as a motor vehicle seat-belt, although it is to be understood that the belt may be used for various different purposes, for example as an aircraft seat-belt or a belt forming part of a safety harness or the like. The belt 1 is of elongate form, thus having a longitudinal axis and a transverse axis. The belt is woven from one or more monofilament weft yarns, which extend transversely to the longitudinal axis of the belt, and, in this embodiment, a plurality of multifilament warp yarns which extend parallel with the longitudinal axis of the belt.

A central region 2 of the belt is formed using a conventional weaving technique, but the belt has two edge regions 3, 4 where a specific belt structure is provided, examples of which will now be described.

Figure 2:
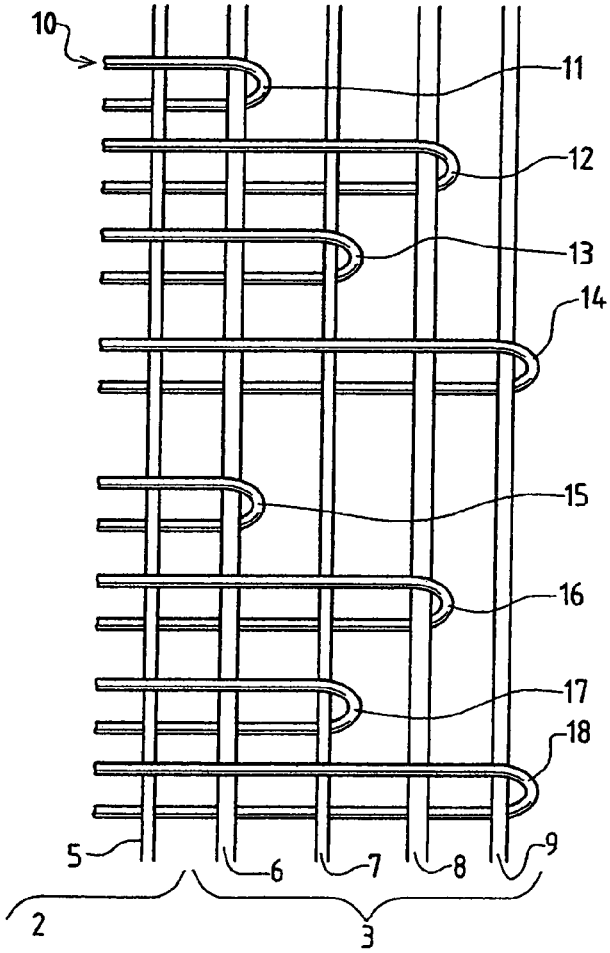
FIG. 2 is an enlarged view of part of the edge section of the belt during manufacture thereof.

Referring to FIG. 2, a peripheral part of the central region 2 of the seat-belt is illustrated together with the edge region 3.

In this embodiment the warp yarns are shrinkable yarns. Within the central region 2 the warp yarns, exemplified by the warp yarn 5, have a predetermined shrinkage characteristic whereas in the edge region 3 the warp yarns 6, 7, 8, 9 have a different shrinkage characteristic. The shrinkage characteristic of the warp yarns 6 to 9 in the edge region 3 is such that these yarns will shrink less than the warp yarns, such as the warp yarn 5, in the central region 2, during a shrinking procedure. This may be achieved by pre-shrinking, to a certain extent, the warp yarns 6 to 9 for use in the edge region 3.

In this embodiment of the invention the warp yarns in the central region 2, as exemplified by the warp yarn 5 may be of, for example, 1670 dtx i.e. 1670 g/10000 m yarn (equivalent to 1500 Denier (i.e. 1500 g/9000 m)) whereas the warp yarns 6 to 9 in the outer region 3 may be much lighter and thinner, being, for example, 560 dtx yarn (equivalent to 500 Denier). The belt 1, as shown in FIG. 2, is woven using at least one monofilament weft yarn 10. The monofilament weft yarn 10 may be thin, having a diameter of approximately 0.3 mm or less. The multifilament warp yarns also preferably have a similar thickness. The particular weaving pattern disclosed hereinafter has been found to provide a belt having a thickness of less than 1.05 mm and which is very flat across its entire width.

It is to be understood that the weaving of the belt is accomplished in such a way that the weft yarn is caused to execute a series of "passes" across the warp yarns. On each pass, as the weft yarn extends across the central region 2 of the belt, the weft yarn is woven, in a conventional way, with the warp yarns. However, on reaching the edge regions 3, a specific weave is achieved to provide a soft edge. The same weave is used for both of the edge regions 3 and 4, and will be described with reference to the region 3.

In the edge region 3 the weft yarn on each pass extends to a predetermined warp yarn, extends around that warp yarn and then passes back across the central region 2. On each successive pass the weft yarn is looped around a different selected warp yarn in the edge region. Thus, on each pass the weft yarn is looped around a different warp yarn which is not the same as the warp yarn selected for the preceding pass on the following pass. The weft yarn, on successive passes, extends to each of the warp yarns in the edge region, until the weft yarn has been looped round all of the warp yarns in the edge region creating a predetermined "pattern". That "pattern" may then be repeated.

In the example illustrated in FIG. 2, on a first pass 11 of the weft yarn, the weft yarn is looped around the warp yarn 6 so that warp yarn 6 becomes the terminal yarn for that pass. On a second pass 12 the weft yarn passes to one side (behind) the first two warp yarns, and is looped around the warp yarn 8 which is spaced from the warp yarn 6 by the warp yarn 7, thus being the next-but-one warp yarn. Warp yarn 8 becomes the terminal warp yarn for the second pass 12. On a third pass 13 the weft yarn 10 passes to one side of (behind) the first warp yarn, and is looped around the warp yarn 7 (the terminal warp yarn for the third pass), which is next to the warp yarn 6. On the next pass 14 the weft yarn passes to one side of (behind) the first three warp yarns, and is looped around the outer-most warp yarn 9 (the terminal warp yarn for this pass 14), which is next-but-one to the warp yarn 7. Thus, at this stage, the weft yarn has been looped around each of the four warp yarns in the edge region of the belt, thus creating a "pattern". The "pattern" then begins to repeat itself, and the next pass, pass 15, is such that the weft yarn is again looped around the initial warp yarn 6 as the terminal warp yarn. The next pass 16 is such that the weft yarn is passed behind the first two warp yarns and is looped around the terminal warp yarn 8, and the next pass 17 is such that the weft yarn is passed behind the first warp yarn 6 and is looped around the warp yarn 7 as the terminal warp yarn. The final pass, pass 18, is such that the weft yarn is looped around the outer-most warp yarn 9 as the terminal warp yarn. The "pattern" has repeated, and then repeats repeatedly.

Following this weaving process, the webbing belt is shrunk. This may be achieved by placing the belt in an oven at a temperature between 180° C. and 230° C., and preferably between 200° C. and 230° C. All of the yarns of the belt then shrink, not only the warp yarns but also the weft yarns. Because the warp yarns 6, 7, 8 and 9 in the edge region have been pre-shrunk to have a different shrink characteristic to the warp yarns, such as the warp yarn 5, in the central region 2 of the belt, the warp yarns 6 to 9 in the edge region do not shrink as much as the warp yarns in the central region 2.

As a consequence of the shrinking of the yarns the points where each pass 11 to 18 of the weft 10 is looped round the respective warp yarn 6 to 9 are drawn inwardly towards the central region 2 of the belt. The region of each of the warp yarns 6 to 9 which extend between two adjacent passes of the weft which are looped around that warp yarn (for example the region of the warp yarn 6 between the pass 11 and the pass 15), forms a gently outwardly directed arcuate length of yarn, which still has some resilience, and which therefore is relatively soft. This arcuate length of yarn is created as the warp yarns 6 to 9 do not shrink as much as the warp yarns 2 in the central region of the belt.

It has been found that with some "patterns" of weave in the edge region 3 or 4, a "hole" can appear in the edge of the belt. Such a "hole" is relatively small and is not in any way dangerous, but, in order to provide a more acceptable edge region, it has now been determined that it is appropriate to use a "pattern" in which, on each successive pass of the weft, the weft is looped around either the next adjacent warp yarn or the next-but-one warp yarn.

Figure 3:
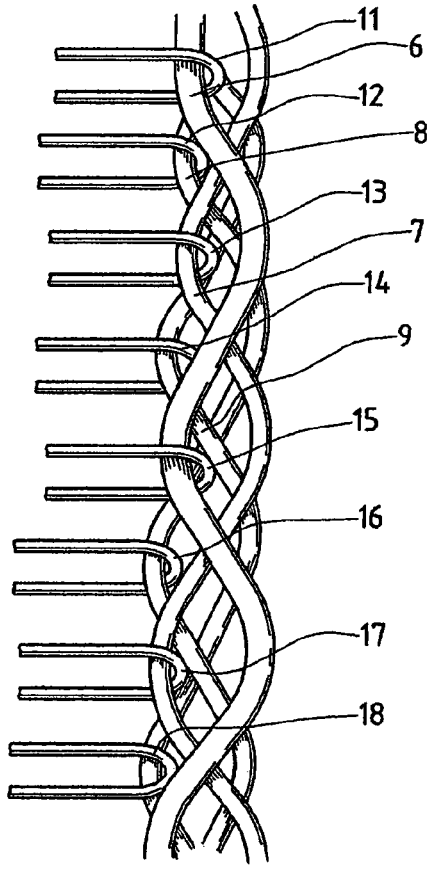
FIG. 3 is a view of the region of the belt shown in FIG. 2 following completion of manufacture of the belt.
Figure 4:
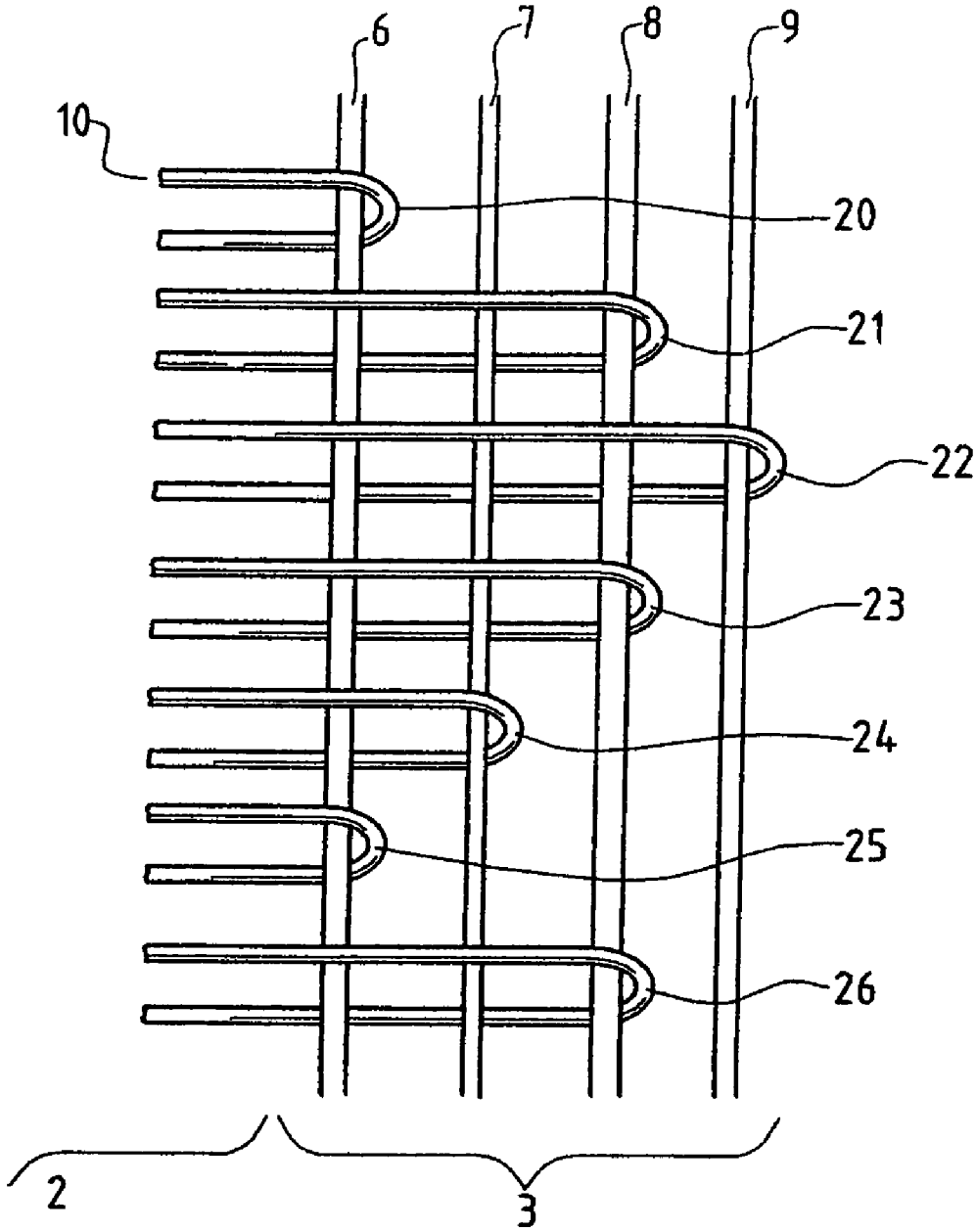
FIG. 4 is a view corresponding to FIG. 3 illustrating an alternative embodiment.

FIG. 4 illustrates four weft yarns 6, 7, 8, 9 of the type shown in FIG. 3 and also shows a monofilament weft 10. In FIG. 4 the first pass 20 of the monofilament 10 is looped around the warp yarn 6 which is closest to the central region 2 of the belt. The next pass 21 is looped around the next-but-one warp yarn, which is warp yarn 8. The next pass, 22, passes around the next adjacent warp yarn 9.

The next pass 23 is again looped around the next adjacent warp yarn which is the warp yarn 8. The next pass 24 is looped around the next adjacent warp yarn which is the warp yarn 7. The next pass 25 begins to repeat the pattern being looped around the warp yarn 6. Similarly the next pass, pass 26, corresponds with pass 21, being looped around the next-but-one adjacent warp yarn 8.

By ensuring that successive passes of the weft are always looped around the next or the next-but-one warp yarn, a superior quality of edge may be achieved for the belt.

While the invention has been described with reference to a belt which has two opposed edges which have equivalent properties, a belt could be fabricated having only one edge of the type described above, the other edge being of conventional form. The symmetrical belt, as described above, is preferred.

In the present Specification "comprises" means "includes or consists of" and "comprising" means "including or consisting of".

The features disclosed in the foregoing description, or the following Claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of manufacturing a belt, comprising the steps of weaving the belt from a plurality of warp yarns and at least one weft yarn, the belt having a central region and two opposed edges, the warp yarns in the central region having a predetermined shrinkage characteristic, at least one edge region between the central region and an edge of the belt having a predetermined number of warp yarns, each having a lesser shrinkage characteristic than the warp yarns of the central region, the method comprising the steps of passing the weft yarn across the warp yarns to effect a weaving in the central region of the belt, and, in the or each edge region, looping the weft yarn, on each pass, around a selected terminal warp yarn, and on subsequent passes the weft yarn loops around a different terminal warp yarn so that after a plurality of successive passes the weft yarn is looped around each of the warp yarns in the edge region, the method comprising the subsequent step of shrinking the yarns in the belt.

2. A method according to claim 1 wherein the shrinking of the yarns is effected by passing the belt through an oven at a temperature of 180°–230° C.

3. A method according to claim 1 wherein the yarns in the edge region are shrinkable yarns which are partially pre-shrunk.

4. A method according to claim 1 where on each successive pass the weft yarn is looped around a different warp yarn, which is not the same as the warp yarn selected for the preceding pass or for the following pass.

5. A method according to claim 1 wherein, in a series of successive passes the warp yarn is looped around each of the weft yarns in the edge region in a predetermined pattern, with that pattern subsequently being repeated.

6. A method according to claim 1 wherein the warp yarns used in the edge region are thinner and lighter than the warp yarns used in the central region.

7. A method according to claim 6 wherein the warp yarns used in the edge region are substantially 500 Denier (560 dtx) yarns, whereas the warp yarns used in the central region are substantially 1500 Denier (1670 dtx) yarns.

8. A method according to claim 1 wherein the weft yarn is of a diameter of 0.3 mm or less.

9. A method according to claim 1 wherein on each successive pass the weft yarn is looped around a warp yarn which is next or next-but-one to the warp yarn selected for the preceding pass.

10. A method of manufacturing a webbing belt from warp yarns and a monofilament weft yarn, the method comprising the step of weaving the weft yarn with the warp yarns to produce a belt having a central region which is conventionally woven, and having at least one edge region in which the weft yarn, on successive passes is looped, passes around different selected terminal warp yarns in the edge region.

11. A method according to claim 10 wherein the weft yarns in the edge region have a lesser shrinkage characteristic than the warp yarns of the central region, the method including a closing step of shrinking the yarns in the belt.

12. A method according to claim 10 wherein the shrinking of the yarns is effected by passing the belt through an oven at a temperature of 180° C.–230° C.

13. A method according to claim 10 wherein the yarns in the edge region are shrinkable yarns which are partially pre-shrunk.

14. A method according to claim 10 wherein, in a series of successive passes the warp yarn is looped around each of the weft yarns in the edge region in a predetermined "pattern", with that "pattern" subsequently being repeated.

15. A method according to claim 10 wherein the warp yarns used in the edge region are thinner and lighter than the warp yarns used in the central region.

16. A method according to claim 10 wherein the warp yarns used in the edge region are substantially 500 Denier (560 dtx) yarns, whereas the warp yarns used in the central region are substantially 1500 Denier (1670 dtx) yarns.

17. A method according to claim 10 wherein the weft yarn is of a diameter approximately 0.3 mm or less.

18. A method according to claim 10 wherein on each successive pass the welt yarn is looped around a warp yarn which is next to the next-but-one warp yarn selected for the preceding pass.

19. A belt formed from a plurality of warp yarns and at least one weft yarn, the belt having a central region and two opposed edges, there being at least one edge region between the central region and an edge of the belt in which successive passes of the weft yarn are each looped around a different selected terminal warp yarn in the edge region.

20. A belt according to claim 19 wherein each warp yarn in the edge region extends, as an arcuate length of yarn, between adjacent points where that warp yarn is looped by the weft yarn.

21. A belt according to claim 19 wherein, in a series of successive passes the warp yarn is looped around each of the weft yarns in the edge region in a predetermined "pattern", with that "pattern" subsequently being repeated.

22. A belt according to claim 19 wherein the warp yarns in the edge region are thinner and lighter than the warp yarns used in the central region.

23. A belt according to claim 19 wherein the warp yarns in the edge region are substantially 500 Denier (560 dtx) yarns, whereas the warp yarns used in the central region are substantially 1500 Denier (1670 dtx) yarns.

24. A belt according to claim 19 wherein the weft yarn is of a diameter of 0.3 mm or less.

* * * * *